United States Patent [19]

Shimek et al.

[11] Patent Number: 5,076,254

[45] Date of Patent: Dec. 31, 1991

[54] DIRECT VENTED MULTI GLASS SIDE FIREPLACE

[76] Inventors: Ronald J. Shimek, 8944 W. 154 St., Prior Lake, Minn. 55372; Daniel C. Shimek, 5260 W. 132nd St., Apple Valley, Minn. 55124; James F. Wolf, 6168 Marlen Cir., Prior Lake, Minn. 55032

[21] Appl. No.: 675,853

[22] Filed: Mar. 27, 1991

Related U.S. Application Data

[63] Continuation of Ser. No. 515,716, Apr. 27, 1990, Pat. No. 5,016,689.

[51] Int. Cl.[5] ..... F24C 3/00

[52] U.S. Cl. ..... 126/512; 126/85 B; 126/515; 126/528; 126/523; 237/52

[58] Field of Search ..... 126/512, 515, 528, 531, 126/529, 527, 544, 548, 551, 528, 85 B, 83, 99 D, 116 B, 80, 77, 76, 193, 190

[56] References Cited

U.S. PATENT DOCUMENTS

| | | | |
|---|---|---|---|
| 1,676,893 | 7/1928 | Eisele | 126/548 |
| 2,152,374 | 3/1939 | Burr, Jr. | 126/544 X |
| 2,703,567 | 3/1955 | Manchester et al. | 126/83 |
| 3,469,570 | 9/1969 | Wright | 126/544 |
| 4,314,543 | 2/1982 | Bullington | 126/544 X |
| 4,793,322 | 12/1988 | Shimek et al. | 126/85 B X |
| 4,909,227 | 3/1990 | Rieger | 126/85 B X |

*Primary Examiner*—Larry Jones

*Attorney, Agent, or Firm*—John B. Sowell

[57] ABSTRACT

A zero clearance fireplace of the type adapted to be installed against an outside wall of an interior space or room to be heated is provided with six walls which comprise four substantially vertical walls, a top wall and a bottom wall at least two of said vertical walls having airtight glass side walls connected to the frame structure of the fireplace. The bottom wall, the vertical side wall and the top wall are provided with plenum structures which are inner connected to form a heat exchanger. The rear wall is provided with a vertical inner plenum in which outside fresh air is introduced and conducted into a bottom inner plenum below the combustion chamber of the fireplace to provide fresh outside air to the gas burner system in the combustion chamber. The top wall of the fireplace over the combustion chamber is provided with a tapered shape which diverts the exhaust gases from the gas burner in the combustion chamber directly into an exhaust stack so as to generate a high velocity exhaust of the combustion gases which generates a high draft aspiration effect through the combustion chamber.

13 Claims, 5 Drawing Sheets

DIRECT VENTED MULTI GLASS SIDE FIREPLACE

This is a continuation Ser. No. 07/515,716 filed on 27 April 1990 now U.S. Pat. No. 5,016,689.

BACKGROUND OF THE INVENTION

1. Related Aoolications and Inventions

This application is related to our U.S. Pat. No. 4,793,322 issued Dec. 27, 1988 for a "Direct-Vented Gas Fireplace" and to our U.S. Pat. No. 4,852,584 issued Aug. 1, 1989 for a "Universal Fireplace Assembly".

2. Field of the Invention

The present invention relates to zero clearance fireplaces of the type usually installed close to an outside wall of a room to be heated and having an exhaust stack which preferably exits through the close outside wall or through a ceiling and roof using an extension chimney. More particularly, the present invention relates to a prefabricated and factory built direct-vented zero clearance fireplace having one or more airtight glass side walls and a highly efficient, high BTU output gas burner and employs a novel combustion chamber that convection cools the glass side walls to avoid breaking the glass.

3. Description of the Prior Art

In our U.S. Pat. No. 4,793,322 a zero clearance fireplace is shown and described which has a highly efficient heat exchanger combined with a gas burner system that meets all of the American National Standard Institute's specifications for gas appliances in ANSI specification Z21.50 and Z21.60. These specifications have been adapted by the American Gas Association (AGA) design certification standards for direct vented multiglass side fireplaces.

Our U.S. Pat. No. 4,852,548 shows and describes a universal fireplace of the type adapted to be used with wood burning systems or a gas burning system. One of the objects of the invention of this latter patent is to provide novel cooling means and combustion gas diverting means for cooling low temperature tempered glass panels which are provided in the doors instead of expensive high temperature glass.

These two prior art patents are concerned with low to medium BTU output burners and fireplace heaters which fall into the range of 15 to 27,000 BTUs. This amount of heat is insufficient to heat a small home or a vacation home or an apartment and when installed in such homes or living units must be augmented by other heating systems.

It would be extremely desirable to provide a high BTU zero clearance fireplace with a gas burner system having sufficient heat output to heat a small home or apartment without auxiliary heating means and which is provided with decorative multiglass side walls and produces high efficiency with low carbon monoxide and provides a low glass side wall temperature meeting all requirements of the ANSI and AGA.

SUMMARY OF THE INVENTION

It is a principal object of the present invention to provide a multi-side glass fireplace for a high BTU gas burner system.

It is another principal object of the present invention to provide an AGA designed certified direct vented high BTU gas fireplace with glass side walls.

It is another principal object of the present invention to provide a fireplace that utilizes all outside air for combustion and employs excess outside air to cool the glass side walls.

It is another object of the present invention to provide a high BTU gas burner for a multi-side glass fireplace using low temperature glass panels.

It is a specific object of the present invention to provide a novel shaped top wall and diversionary baffle system for a high BTU gas burner combustion chamber in a direct vented fireplace which generates high velocity aspiration of the exhaust combustion gases and the excess cooling air.

It is a general object of the present invention to provide a versatile direct vented gas fireplace capable of generating sufficiently high BTU output at high thermal efficiency to be used in an average size home, vacation home, apartment house or condominium to eliminate the need for secondary heating systems.

According to these and other objects of the present invention there is a provided a box shaped rectangular fireplace having one or more glass side walls. The top, bottom and back side walls of the fireplace are o provided with an interconnecting subwall plenum system which acts as a heat exchanger for heating room air. The top side wall subwall plenum is connected to novel side wall plenums which exhaust heated room air along the glass side walls. The top wall of the fireplace is provided with a novel tapered innerwall combustion chamber structure which promotes and increases the velocity of burned combustion gases being exhausted and passed into the exhaust stack in a manner which aspirates outside combustion air and cooling air into the gas burner system.

DESCRIPTION OF THE PREFERRED EMBODIMENTS

Figure 1:
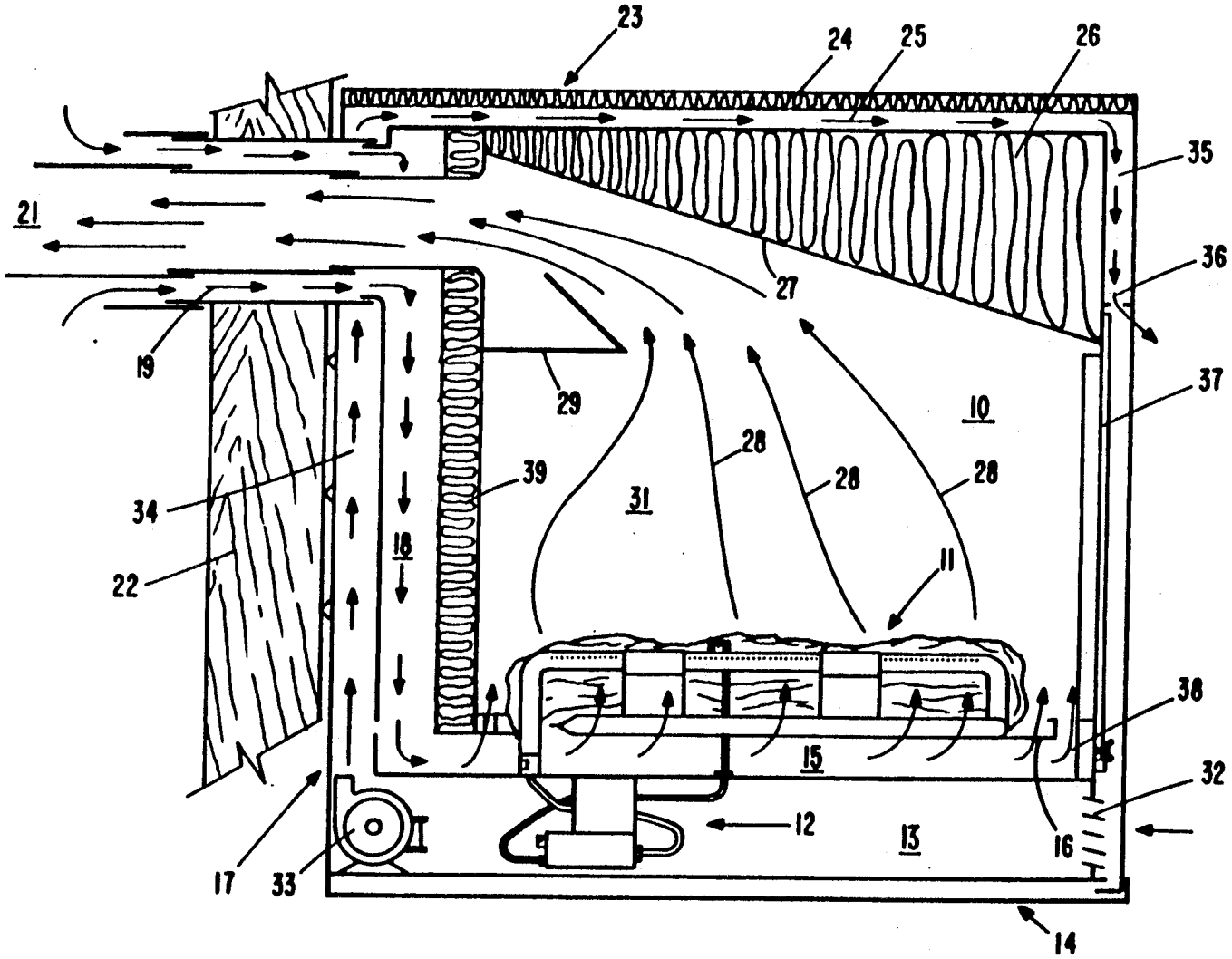
FIG. 1 is a side elevation in section of a preferred embodiment zero clearance fireplace.

Refer now to FIG. 1 showing a side elevation in section taken through a preferred embodiment fireplace according to the present invention. Fireplace 10 is provided with a high BTU gas burner system 11 which has inlet valves and control valves 12 located in a plenum 13 formed along the bottom outside wall 14 which further comprises an inner subwall or plenum 15 through which fresh outside air is introduced to the bottom sheet metal pan 16 to be described in more detail hereinafter. The fresh outside air is introduced into plenum 15 from a vertical side wall 17 shown as a rear wall. Rear wall 17 is provided with a vertical inner plenum 18 which connects to the outside coaxial inlet stack 19 surrounding the exhaust stack 21 which is mounted through outside wall 22. Preferably the exhaust stack 21 and coaxial inlet stack 19 are provided with support means and insulating means which permit rapid and efficient installation. Such exhaust and inlet stacks are explained in our prior art patents and references cited therein.

Top wall 23 is shown comprising an outer insulating subwall 24, an insulating and air conducting middle subwall 25 and an inner insulated subwall 26 which is preferably insulated with heat resisting insulation or may be a dead air space insulating chamber. The inner panel 27 is juxtaposed the combustion chamber 31 located centrally in the fireplace and is shown to be tapered so as to divert the exhausting combustion gases shown at lines 28 into the exhaust stack 21 without diversionary resistance so as to enhance the velocity of the exhausting gases which produce an aspirating or suction effect in the combustion chamber and sucks outside fresh air from the plenum 15 into the combustion chamber through the burner system 11. A diversionary baffle 29 may be provided in the combustion chamber 31 opposite the inner panel 27 to further enhance the aspiration effect of the exhaust gases 28. Room air to be heated enters plenum 13 through louvers or other means 32 and is circulated by bloWer 33 through outside subwall plenum 34 into middle subwall 25. The heated air in subwall 25 is passed into one or more side wall plenums 35 and is preferably exhausted through the aperture 36 in the lower flange of the open box structure 35 into the room as heated air.

Side wall glass panel 37 is preferably a low cost tempered glass which is cooled by the outside air conducted through cooling slots 38 provided at the perimeter of the bottom sheet metal pan 16 along the edges of the side walls having glass panels 37. In the preferred embodiment of the present invention, sufficient outside air is provided beneath the burner system 11 to promote efficient and complete combustion so that the cooling air entering through slots 38 is not sucked into the combustion zone but is encouraged to rise vertically along the glass side walls 37 to efficiently cool the glass panels before being drawn into and mixed with the combustion gases 28.

It will be noted that subwall 26 and inner subwall 39 adjacent the combustion chamber are shown to be insulated. However, the bottom sheet metal pan and the side wall glass panel 37 are preferably uninsulated and are cooled by outside fresh air being drawn into the combustion chamber 31.

Figure 2:
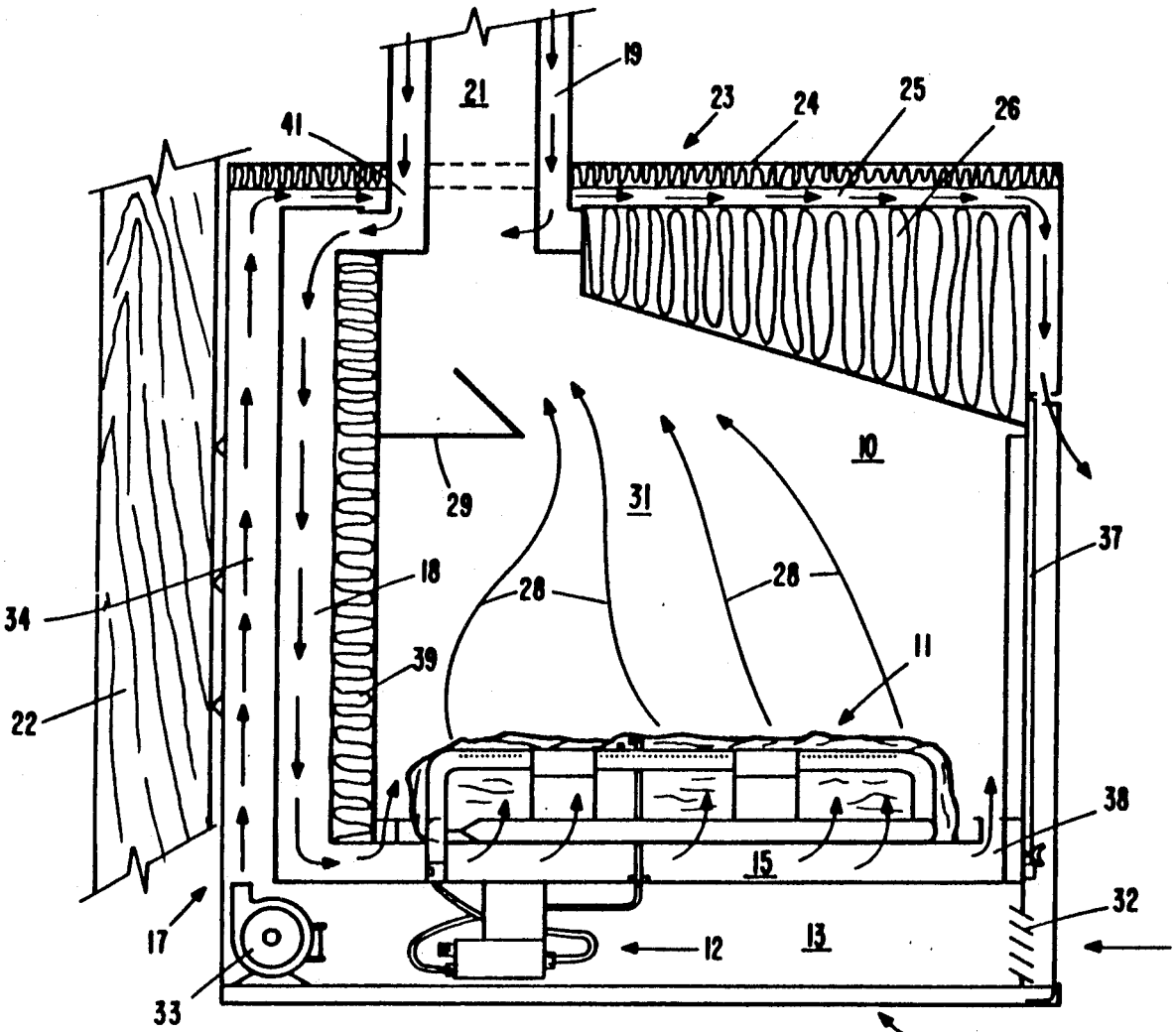
FIG. 2 is a side elevation in section of another preferred embodiment zero clearance fireplace.

Refer now to FIG. 2 showing a side elevation of another preferred embodiment zero clearance fireplace of the type shown in FIG. 1. The only difference between the fireplace shown in FIG. 1 and the fireplace shown in FIG. 2 is that the exhaust stack 21 exits vertically through the top wall 23 rather than through the side wall 17. An inlet plenum Chamber 41 connects to the coaxial inlet stack 19 and to the vertical inner plenum 18. The top wall 23 is further modified by removing a portion of the tapered inner insulating subwall 26 to provide access to the inlet and exhaust stacks 19, 22. The bottom wall 14 and the rear wall 17 do not require modification for this preferred embodiment and may employ the identical burner system 11. Further, the heat exchanger system which comprises plenums 13, 25 and 34 as well as blower 33 are identical thereto and numbered the same, thus, do not require further explanation.

In the preferred embodiment of the present invention it is cheaper to run the inlet stack 19 and exhaust stack 22 directly through a vertical outside wall 22 as shown in FIGS. 1 and 2. Sometimes it is desirable to provide the inlet and exhaust stacks in the top wall 23 inside of a chase wall enclosure which may exit vertically through the ceiling outside wall or may be turned horizontally 90° and exit through the wall 22. Having explained the preferred embodiment of the present invention which employs a highly efficient heat exchanger it will be appreciated that there may be instances in which the present invention fireplace could be desirably used in conjunction with a primary heating system which already exists In such instances the heat exchanger system may be completely eliminated or used as dead insulation space or provided with further insulation. The novel combustion chamber and burner system still acts independently to protect the side wall glass.

Figure 3:
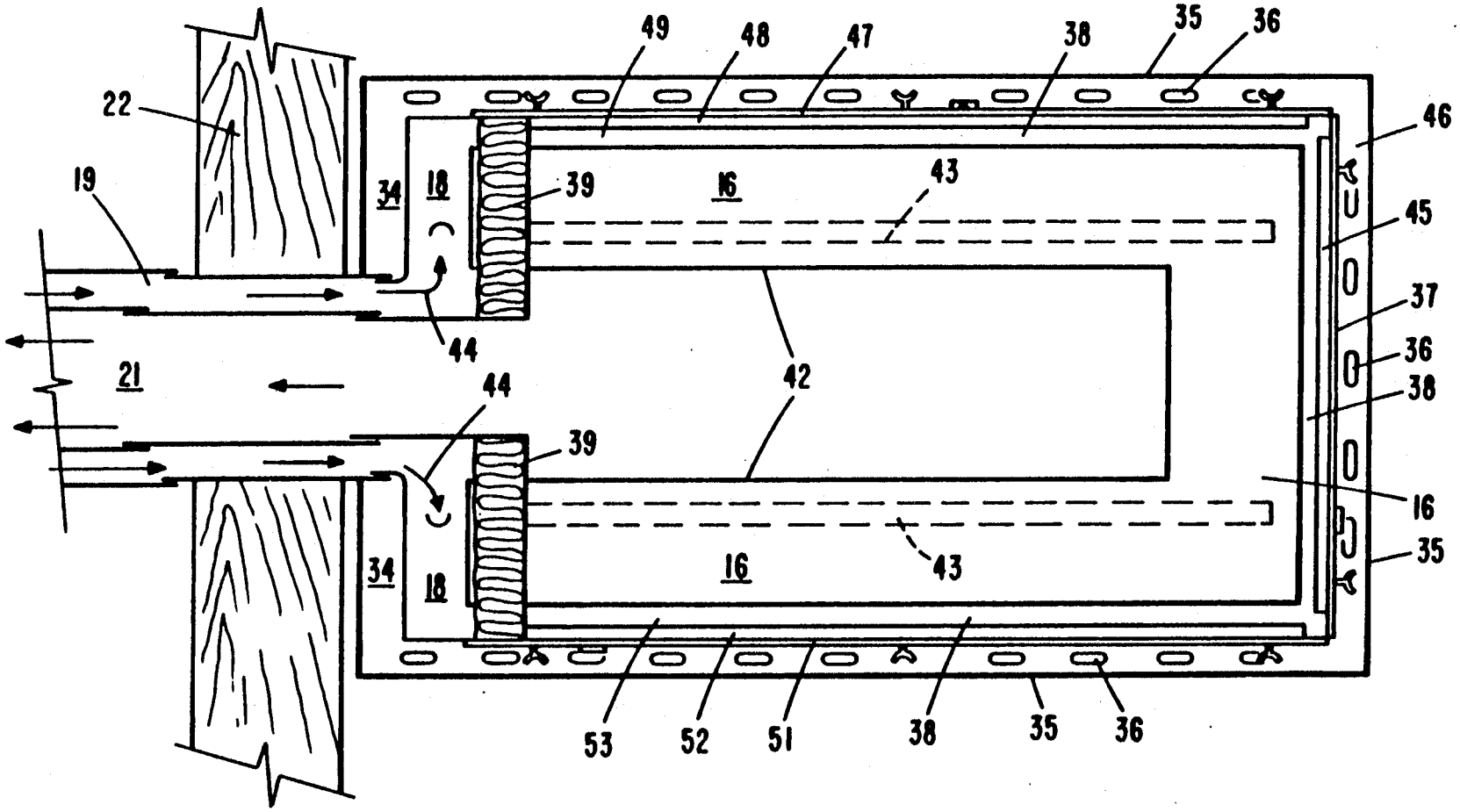
FIG. 3 is a top view in section showing the bottom sheet metal pan which supports the burner system and provides perimeter outside air cooling slots to cool the glass side walls.

Refer now to FIG. 3 showing a top view in section taken through the exhaust stack above the bottom pan 16 which supports the burner system. Pan 16 is shown having a large rectangular opening 42 directly under the burner system (not shown). Sheet metal pan 16 is shown being supported on Z shaped or channel shape support members 43 which extend to the left completely underneath inner subwall 39 and terminate at the right edge of vertical inner plenum 18, fresh air supply plenum 18, which is connected to the outside air source through coaxial inlet stack 19. It will be understood that the air shown at arrows 44 drops vertically downward in plenum 18 and enters the fresh air plenum 15 under the burner system 11. Thus, the opening 42 under the burner system 11 permits the maximum amount of fresh combustion air to be drawn into the combustion chamber area 31. In the preferred embodiment of the present invention a steel support mesh (not shown) is placed over the aperture 42 to assist in supporting the burner system 11.

The side wall glass panel 37 shown in FIGS. 1 and 2 are shown attached to the sheet metal structure 45 comprising a part of the fireplace system and held in place thereto by wing nuts and L brackets 46. Sheet metal pan 16 stops short of the sheet metal 45 so as to provide an elongated slot 16 at the edge thereof adjacent the glass panel 37. Air rising from the slot 16 is not required for total combustion of the gas burner system, thus, rises almost to the top of the glass before being diverted into the combustion zone. The cool outside air sufficiently cools the glass panel 37 to permit use of tempered glass instead of high temperature glasses such as pyroceramic glass. Similarly, side wall glass panel 47 is mounted on sheet metal side wall 48 adjacent and elongated cooling slot 49 provided at the edge of sheet metal support pan 16. In similar manner side wall glass panel 51 is supported on sheet metal 52 adjacent elongated cooling slot 53 provided along the edge of sheet metal panel 16.

Air entering the heat exchanger plenum 13 is moved into the vertical plenum 34 and rises to the top middle subwall plenum 25 where it is diverted into the side wall plenums 35 provided over the side walls having glass panels but not over the side walls which would not have glass panels which are preferably insulated. The heated air from the top plenum 25 enters the side wall plenums 35 and exits vertically through the apertures 36 in the lower flanges thereof. It is apparent such exit aperture 36 could be arranged so that the heated air is diverted horizontally into the room.

Figure 4:
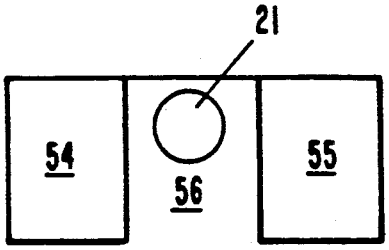
FIGS. 4, 5, 6, 7 and 8 are each schematic sections in elevation showing preferred tapered interior top walls for the combustion chambers shown in FIGS. 1 and 2.
Figure 5:
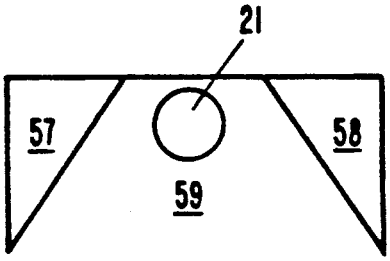

Refer now to FIGS. 4 to 8 showing schematic cross-sections in elevations of tapered inner panels at the top of the combustion chamber 31. In FIG. 4 there are provided two dead air or insulated spaces 54 and 55 on either side of the exhaust stack 21 and the space 56 therebetween is provided with one of the tapered shaped inner panels to be explained hereinafter. In FIG. 5 different shaped insulating or dead air spaces 57 and 58 are shown on either side of the stack 21 and provide a space 59 therebetween which will be closed with one of the taper shapes to be explained hereinafter.

Figure 6:
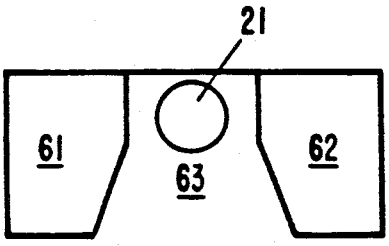

FIG. 6 shows yet another form of dead air space or insulating space 61 and 62 on either side of the exhaust stack 21 and has a space 63 for a tapered inner panel therebetween.

Figure 7:
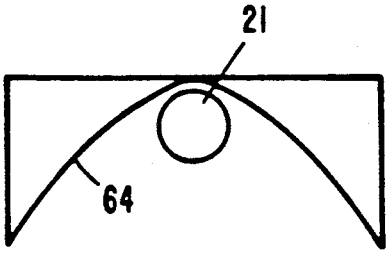
Figure 8:
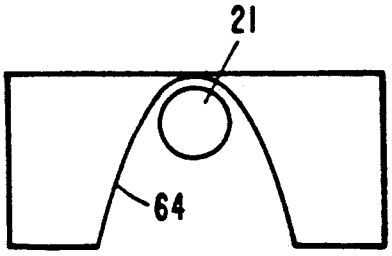

FIG. 7 and FIG. 8 show yet other forms of tapered top walls which will divert exhaust gases into the exhaust stacks 21 at high velocity. These shapes 64 and 65 are complex curvatures and will require complex tapered shapes to achieve the desired inner top panel structure. When such shapes 64 and 65 are employed, they are manufactured as a unitary roof structure and then tilted at the desired angle and the edge flanges thereof removed to provide a desired taper shape as will be explained hereinafter.

Figure 9:
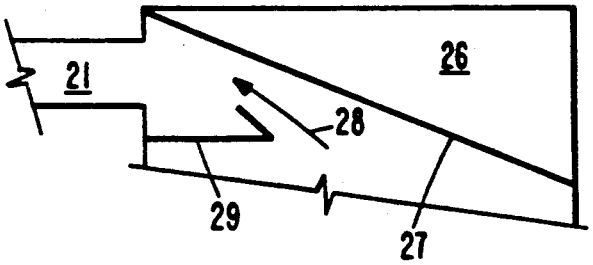
FIGS. 9, 10 and 11 are each schematic sections in elevation which are taken through the tapered interior top walls of the combustion chamber at an angle which is 90. to the section shown in FIGS. 4 to 8.

Refer now to FIG. 9 showing a simple and desired tapered inner panel 27 which can be employed to extend between the insulating spaces 54 and 55 or 57 and 58 or 61 and 62 as explained hereinbefore. The diversionary panel 29 has been found to enhance the aspiration effect of the exhaust gases 28 being directed into the exhaust staok 21. It is not necessary to provide heat insulation inside the inner insulating subwall 26 if sufficient insulation is provided in an exterior subwall.

Figure 10:
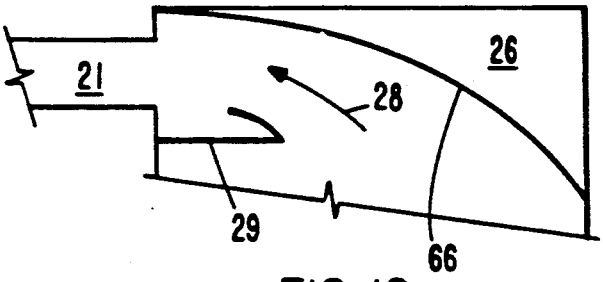

Refer now to FIG. 10 showing a curved inner panel 66 which serves the identical same purpose as the inner wall 27 shown in FIG. 9. This more complex shape may be formed during the manufacture of the top wall system by placing stops or positioning means along the sides of the insulating structures 54 and 55 etc.

Figure 11:
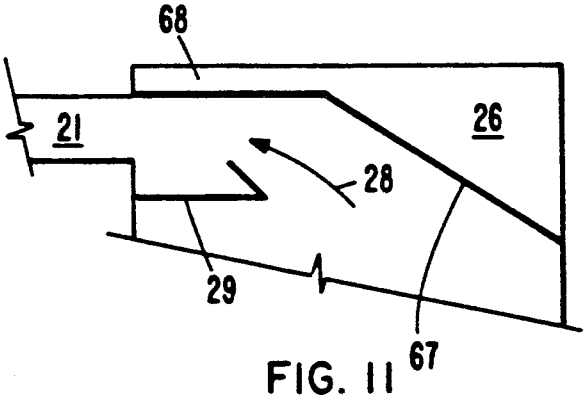

Refer now to FIG. 11 showing yet another inner panel 67 which is designed for ease of manufacture and further provides additional dead air space insulation at portion 68 of the inner insulated subwall 26. Having explained several different tapered top wall structures for the combustion chamber 31 which may be used in conjunction with side wall insulating portions, it will be understood that various combinations and modifications of the top wall structure 27 may be made which achieve the enhancement of the velocity of the exhaust gases through the stack 21 which assist in cooling glass side walls 37.

Figure 13:
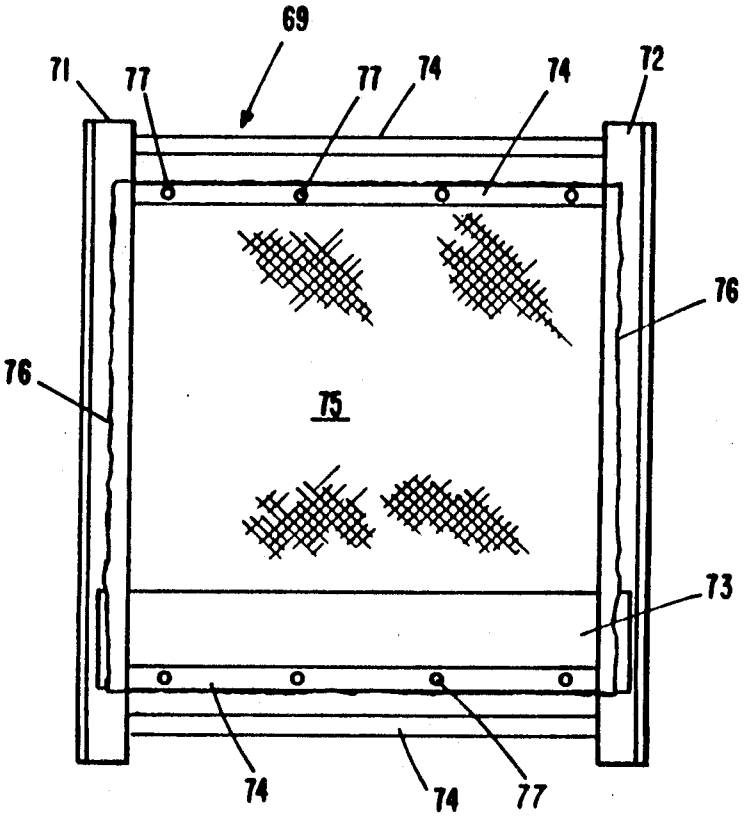
FIG. 13 is a front elevation of the mesh glass protector shown in FIG. 12.
Figure 12:
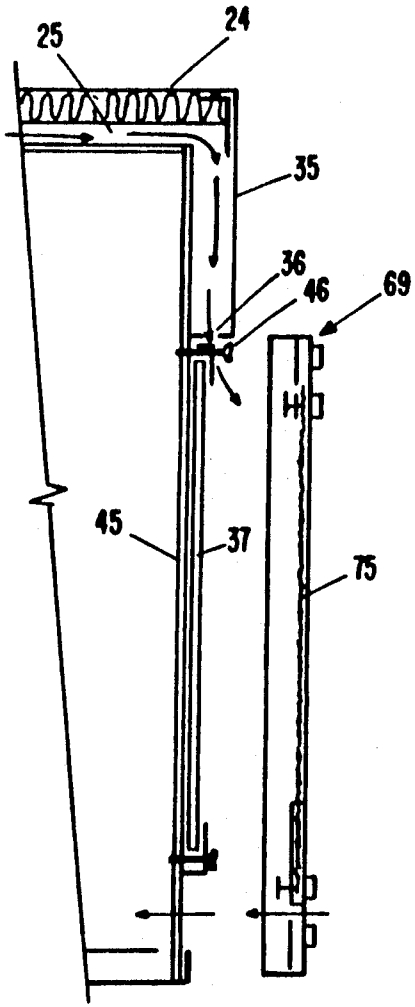
FIG. 12 is a partial section in elevation showing a side wall of the type having a fixed glass panel and a side wall plenum and a mesh glass protector which is removed therefrom.

Refer now to FIG. 12 showing one of the side walls of the preferred embodiment fireplace structure having a fixed glass panel 37, 47 or 51 and a novel side wall plenum 35. A removable mesh glass protector 69 is shown opposite the side wall 37. Wing nuts and L brackets 46 are shown holding the glass panel 37 onto the sheet metal 45 of the fireplace structure. In addition thereto a removable mesh glass protector system 69 is shown juxtaposed the glass panel 37 and is shown in rear elevation in FIG. 13 where it comprises two angle shaped structural members 71 and 72 which are interconnected at the bottom by a rigid steel plate 73. Four decorative metal trim pieces 74, which may be anodized to provide decorative color strips, are mounted across the front of the protector 69. The mesh screen 75 is shown having random shaped edges 76 for purposes of illustration only and may be completely concealed from view when folded into edge fasteners of the type employed with window screens and fireplace screens. In the preferred embodiment of the present invention the mesh 75 is made from small wire and opened sufficiently that it is virtually transparent to a person viewing the fire at a distance of more than four or five feet. However, the open mesh 75 shown attached by fastener 77 is sufficiently rigid when drawn taunt or tight to prevent children from being able to touch the hot glass panel 37. Mesh screen 75 provides a further safety factor in the event of some shock or force which would be great enough to fracture the tempered glass.

Having explained the preferred embodiment of the present invention employing a high BTU gas burner system in a multiglass side wall fireplace system, it will be appreciated that such high output direct vented gas fireplace systems may be employed for the total heating system in a small house, apartment of condominium, etc. while achieving thermal efficiency with low carbon monoxide output. The prefabricated fireplace provides a safe and aesthetic decorative gas fireplace system which is pleasing to the viewer especially when artificial gas logs are used as the preferred gas burner system.

What is claimed is:

1. A zero clearance fireplace of the type adapted to be installed against an outside wall of an interior space to be heated, comprising:

a box shaped fireplace having six walls comprising four substantially vertical walls, a top wall and a bottom wall, at least two of said four vertical walls having an airtight glass side wall connected to the sides of the fireplace structure, one of the remaining side walls or the top wall having an exhaust connection for insertion through an outside wall of the space to be heated, a combustion chamber in said box shaped fireplace located within and spaced away from the outer dimensions of said six walls, said vertical side wall which is adapted to be placed against an outside wall having a plenum into which fresh outside air is drawn to provide on of a plurality of heat insulating sub walls, said outside air insulating subwall being connected to fresh air supply means in the bottom wall of said fireplace, said fresh air supply means in said bottom wall having openings therein communicating with a gas burner system to provide sufficient outside combustion air to promote complete efficient combustion, duct means having elongated apertures therein along the side edges of the vertical side walls which are provided with glass panels to provide cooling air for said glass side walls in said combustion chamber, said duct means being coupled to said outside air subwall, and said top wall having a tapered shape subwall which diverts the exhaust gases nonreversibly from said gas burner system in said combustion chamber and said cooling air from along said glass side walls at high velocity into said exhaust stack to generate a high draft aspiration effect through said combustion chamber.

2. A zero clearance fireplace as set forth in claim 1 which further includes diversionary baffle means cooperating with said tapered shaped subwall to promote high velocity exit of said exhaust gases into said exhaust stack.

3. A zero clearance fireplace as set forth in claim 1 wherein said bottom wall, the vertical side wall which is adapted to be placed against said outside wall and said top wall are each provided with a subwall plenum connection thereto to form a heat exchanger for taking in room air to be heated and exhausting heated room air through the plenum in the top wall into the room to be heated.

4. A zero clearance fireplace as set forth in claim 3 which further includes side wall plenums operatively connected to said plenum in said top wall and having exhaust apertures therein for exhausting heated air into said room to be heated.

5. A zero clearance fireplace as set forth in claim 3 wherein said side wall plenums are connected to the top and to the vertical subwall plenums of said heat exchanger only on the side walls having glass panels.

6. A zero clearance fireplace as set forth in claim 1 which further includes a mesh glass protector mounted on the side of said fireplace over said glass in said glass side wall.

7. A zero clearance fireplace as set forth in claim 6 wherein said mesh glass protector comprises a pair of vertical structural frame members and a horizontal structural sheet member connected thereto.

8. A zero clearance fireplace as set forth in claim 7 wherein said horizontal structural sheet member is connected to and provides support for a substantially invisible mesh screen arranged parallel to and separated from said glass panel.

9. A zero clearance fireplace as set forth in claim 1 wherein said duct means comprise elongated ducts extending along the sides of said sidewalls.

10. A zero clearance fireplace as set forth in claim 1 wherein said duct means comprises a duct along the outside walls of two parallel subwalls.

11. A zero clearance fireplace as set forth in claim 10 wherein said duct means further comprises a duct perpendicular to and connected to the ducts along the outside walls of said two parallel subwalls.

12. A zero clearance fireplace as set forth in claim 11 wherein said duct perpendicular to and connected to the ducts along the outside walls of said two parallel subwalls comprises a duct open on two sides.

13. A zero clearance fireplace as set forth in claim 12 wherein said duct open on two sides opens into an elongated slot on one side and opens into said ducts along said outside walls on the other open side.

* * * * *